United States Patent [19]

Miller

[11] Patent Number: 4,903,522

[45] Date of Patent: Feb. 27, 1990

[54] POP RIVETER TOOL

[76] Inventor: Thomas Miller, 2208 Flint Hill Dr., Wentzville, Mo. 63385

[21] Appl. No.: 296,202

[22] Filed: Jan. 11, 1989

[51] Int. Cl.[4] ..... B21J 15/34

[52] U.S. Cl. ..... 72/391; 72/453.17

[58] Field of Search ..... 72/391, 453.17, 114; 29/243.53

[56] References Cited

U.S. PATENT DOCUMENTS

| | | | |
|---|---|---|---|
| 3,367,166 | 2/1968 | Newton et al. | 72/453.17 |
| 3,451,248 | 6/1969 | Bell | 72/453.17 |
| 4,062,217 | 12/1977 | Ebbert et al. | 72/453.17 |
| 4,275,583 | 6/1981 | Gilbert et al. | 72/391 |
| 4,281,531 | 8/1981 | Ehmann et al. | 72/391 |
| 4,454,746 | 6/1984 | Schwab | 72/391 |
| 4,515,005 | 5/1985 | Klein | 72/453.17 |
| 4,598,571 | 6/1986 | Oefinger | 72/391 |
| 4,648,258 | 3/1987 | Frearson | 72/391 |
| 4,704,888 | 11/1987 | Frearson | 72/391 |
| 4,754,643 | 7/1988 | Weeks, Jr. et al. | 72/453.17 |
| 4,770,023 | 9/1988 | Schwab | 72/453.17 |

OTHER PUBLICATIONS

"Ebbert Riveting Station", Model No. 15541-50E, Guns 100, 200, & 350, pp. 1-21.

*Primary Examiner*—David Jones

*Attorney, Agent, or Firm*—Bachman & LaPointe

[57] ABSTRACT

The present invention relates to a riveting station including a hand-held tool for installing break stem fasteners. The tool has a vacuum ejection system for removing broken-off stems. The ejection system comprises a bore in the tool communicating with a source of vacuum air and a control device for applying the vacuum for a set period of time. The tool in a preferred embodiment also includes a system for feeding air through the bore to promote self-cleaning of the tool and/or substantially prevent popping of the fastener when the fastener is incorrectly positioned.

10 Claims, 4 Drawing Sheets

POP RIVETER TOOL

The present invention relates to a station for installing breakstem fasteners and in particular to an improved automatic pop riveter tool.

Breakstem fastener tools are used to install fasteners such as rivets or bolts in which a projecting stem is used in the installation process, for example by applying tension and a rear force to the stem. The projecting part of the stem is thereafter broken off in order to produce an installed fastener having a substantially flush head surface. It is common for the tools to be equipped with a device for collection and disposal of the broken stems.

U.S. Pat. No. 4,454,746 to Schwab illustrates a blind riveting tool which utilizes compressed air to blow out broken rivet stems into a disposal container. U.S. Pat. No. 4,281,531 to Ehmann et al. illustrates another blind riveting tool of the air injection type. The compressed air used to operate the tool is also used to create a jet pump effect for sucking the broken rivet stem from the chuck into a disposal chamber.

U.S. Pat. No. 4,598,571 to Oefinger describes a heavy duty power operated blind rivet setting tool having a broken stem or mandrel collection system for drawing the pulled mandrel through the tool to a collection canister at the rear of the tool. The mandrel collection system is subjected to a vacuum by a pressurized air line passing air through a transducer in communication with the canister. The vacuum in the canister draws the pulled mandrel through the tool into the canister. The Oefinger tool is not an automatic pop riveter tool. It has a constant vacuum on it unless the operator manually turns it off. As will become clearer hereinafter, the Oefinger tool differs significantly from the tool of the present invention. For example, the Oefinger tool does not automatically turn the vacuum on when the trigger is pulled to pop the rivet, then shuts itself off after the broken rivet stem is ejected in a disposal container. The Oefinger riveter also lacks the safety and self-cleaning features of the present invention.

U.S. Pat. No. 4,275,583 to Gilbert et al. illustrates yet another riveting tool having a stem-disposal device. The Gilbert tool has an air injector on the tool with air supplied from a hydraulic intensifier console. An air line runs to the top of the tool to supply air for pushing the broken stems out the back of the tool and to a stem disposal container. One of the disadvantages to the Gilbert tool is that broken stems remain inside the tool at all times. Another disadvantage is that you can only use one size rivet with the Gilbert design. This is a problem from the standpoint of having to change tools every time the size of the rivets changes. The Gilbert tool also lacks the safety features and self-cleaning head of the present invention.

U.S. Pat. Nos. 4,648,258 and 4,704,888, both to Frearson, illustrate riveters having an airflow ejector for ejecting broken-off rivet stems. The tool shown in the '258 patent includes a shut-off valve on the bottom of the riveter. The shut-off valve is manually operated by placing the tool on a flat surface. The Frearson type riveter is not an automatic tool which automatically shuts off after ejecting the broken rivet stem.

Many older riveter tools have a constant vacuum on them. It is generally expensive to operate such tools because air to be continually supplied to the tools. Efforts have been made to obtain air savings by incorporating into the tool, a hanger for shutting off vacuum air when the tool is hanging on it. The instruction manual for the Ebbert Riveting Station, Model 15541-50E and Gun Models 100, 200 & 350 illustrates such an arrangement.

It is desirable from an efficiency standpoint to avoid having to hang a tool up or placing it on a flat surface to shut off the unit. A truly automatic tool which can stay with the operator close to the work area is not as yet commercially available. There is also no commercially available tool which comes on only when the trigger is pressed and which automatically shuts off after the rivet mandrel is ejected.

Accordingly, it is an object of the present invention to provide a riveting station having an automatic shut off feature.

It is a further object of the present invention to provide a riveting station as above with a pop riveter having a safety feature for preventing inadvertent popping of a fastener.

It is still a further object of the present invention to provide a riveting station as above with a pop riveter having a self-cleaning feature.

It is yet a further object of the present invention to provide a riveting station as above having considerable economic benefit from a reduction in air consumption.

These and further objects and advantages will become more apparent from the following description and drawings in which like reference numerals depict like elements.

SUMMARY OF THE INVENTION

The foregoing objects and advantages are achieved by the riveting station of the present invention which includes a hand-held tool for installing break stem fasteners such as pop rivets. The tool has a housing, jaw means for grasping the stem or mandrel of the fastener, and means for ejecting the stem after the fastener has been installed. The ejecting means includes a bore in the housing communicating with a source of vacuum air. The broken stem is pulled through the bore by the vacuum air and collected in a container. To reduce the air consumption of the station, the station further includes means for applying the vacuum air to the bore for a limited time period. The vacuum air applying means includes a timing device for supplying a timed flow of air to the valve means for operating the vacuum transducer.

The riveting station of the present invention is further characterized by means for delivering a flow of air to the tool prior to application of the vacuum air. This flow of air serves two purposes. First, it prevents a fastener from being popped when it is in an improper position, i.e. not in its intended hole. Second, it promotes self-cleaning of the tool by blowing metal particles out of the tool.

Operation of the riveting station of the present invention does not occur until the trigger is depressed. When the trigger is depressed, air passes to a control valve and to a vacuum air timing device. The control valve operates the piston in a power booster so as to force hydraulic fluid to a power piston in the tool. With the back and forth motion of the piston in the power booster, exhaust air escapes from the control valve. This exhaust air is used to push the fastener in the tool forward so that it cannot be popped unless it is in the hole where it is to be installed. After the fastener has been popped, a second burst of air blows away any metal particles in the tool thus keeping the jaws clean and not allowing a build up of debris inside the tool. Vacuum air is then applied for a few seconds to remove the broken stem from the tool. Thereafter, the riveting station is automatically shut off.

Still other features of the present invention will be discussed hereinafter.

DETAILED DESCRIPTION OF THE INVENTION

Figure 1:
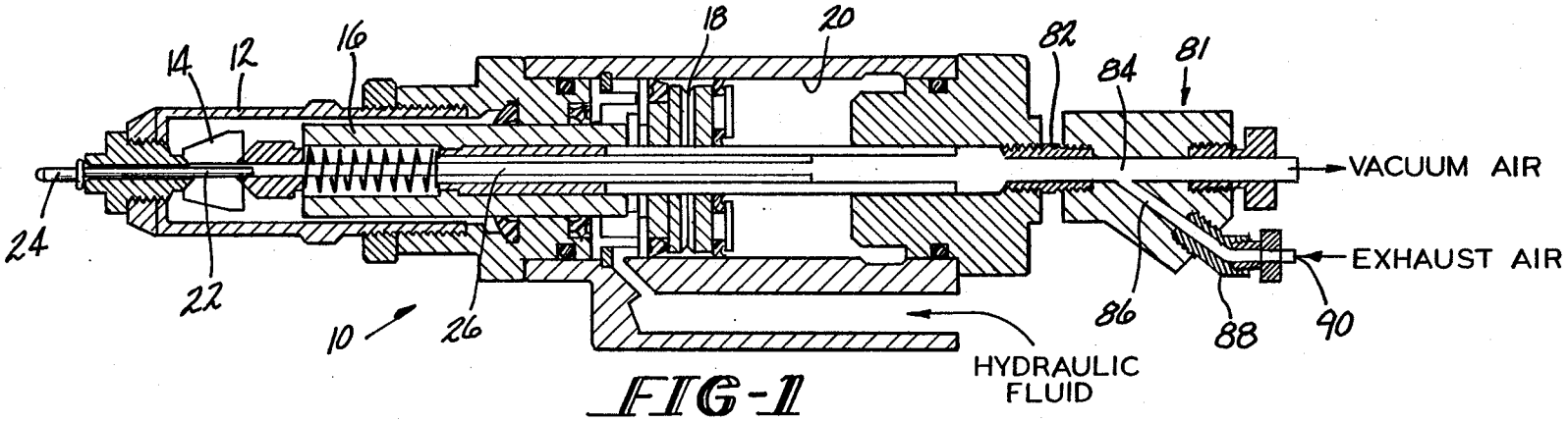
FIG. 1 is a sectional view of a portion of a hand-held pop riveter tool.

Referring now to the drawings, the riveting station of the present invention includes a hand-held tool 10 for installing break stem fasteners such as rivets. As shown in FIG. 1, the tool 10 has a head housing 12 with stem-pulling means comprising a set of jaws 14 for engaging the break stem or mandrel 22 of a rivet or some other fastener 24. The jaws 14 are carried on the front end of a draw rod 16 which is reciprocably movable within the housing by a piston 18 secured to it. The piston 18 slides within a cylinder 20 between an initial position and a retracted position. The manner in which the piston 18 moves between the two positions will be described hereinafter. As the piston 18 moves from its initial position to its retracted position, the jaws 14 grip the mandrel 22 and pull until the fastener 24 is set. As the piston 18 returns to the initial position, the jaws 14 open, releasing the mandrel 22.

The mandrel 22 broken off from the fastener is removed from the tool 10 via a bore 26 which extends rearwardly through the draw rod 16 and the piston 18. The mandrel 22 is removed from the bore 26 by the application of vacuum air. The manner is which this is done will be explained hereinafter.

Figure 3:
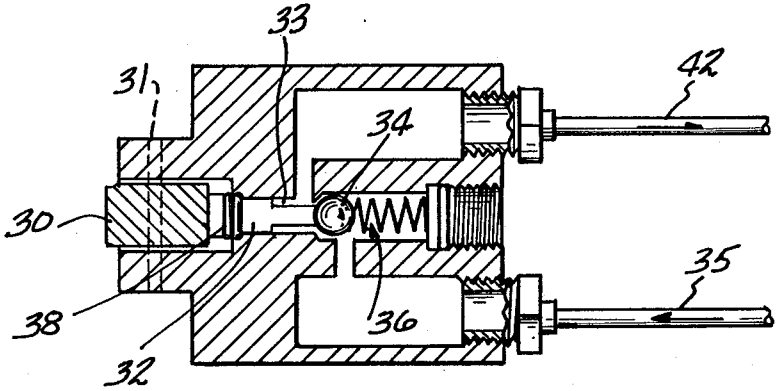
FIG. 3 is a sectional view taken along lines A—A of FIG. 2.
Figure 2:
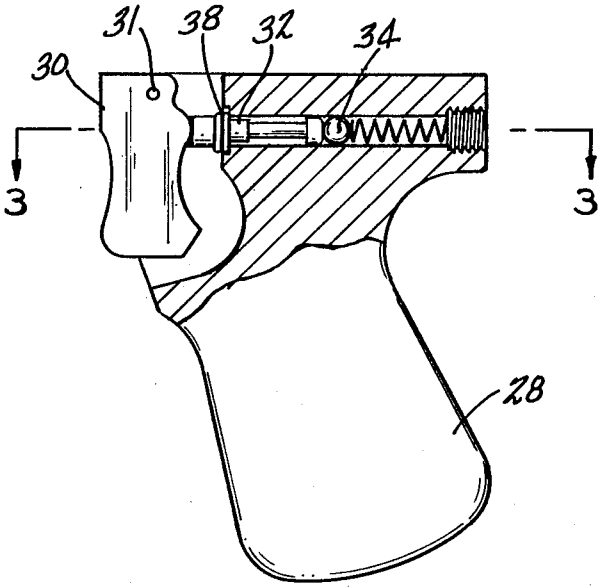
FIG. 2 is a sectional view of the handle portion of the tool of FIG. 1.

As shown in FIGS. 2 and 3, the tool 10 further includes a handle 28 mounted to the housing 12. The handle 28 has a trigger assembly 30 mounted for rotational movement about a pin 31. The trigger 30 pushes against to a valve stem 32 positioned within a chamber 33. When the trigger is depressed, the valve stem moves ball valve 34 off its seat. This lets air from a source of air not shown flow through air line 35 into chamber 36 and from there into return line 42. In a manner to be described in more detail hereinafter, the return air in line 42 acts as pilot air for initiating action of a control valve 40 for providing hydraulic fluid to the tool 10 to move the piston 18 between its two positions and for initiating the operation of a timing device 44 for limiting the period of time vacuum air for ejecting mandrel 22 is applied to bore 26. O-rings 38 are provided on the front of the valve stem 32 to act as a seal when the trigger is depressed.

Figure 4:
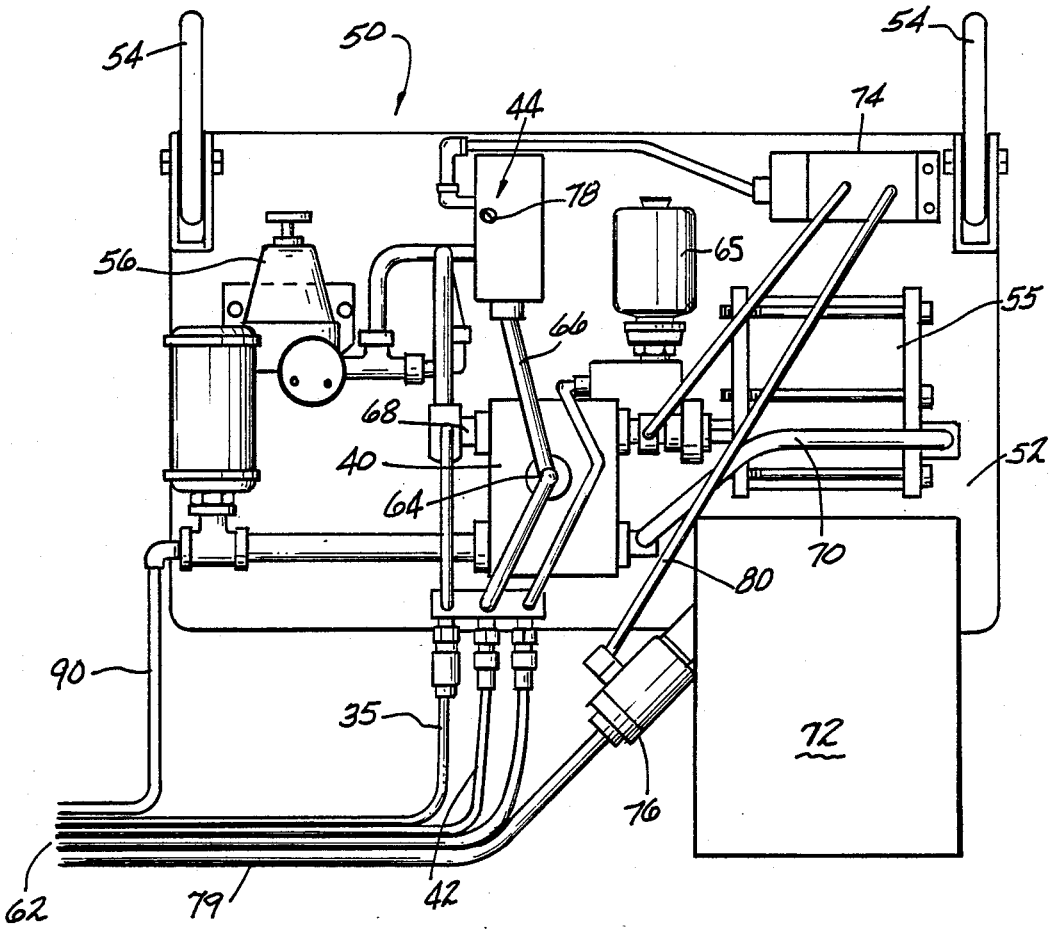
FIG. 4 is a schematic representation of the power booster and ejector assembly used in conjunction with the tool of FIG. 1.
Figure 5:
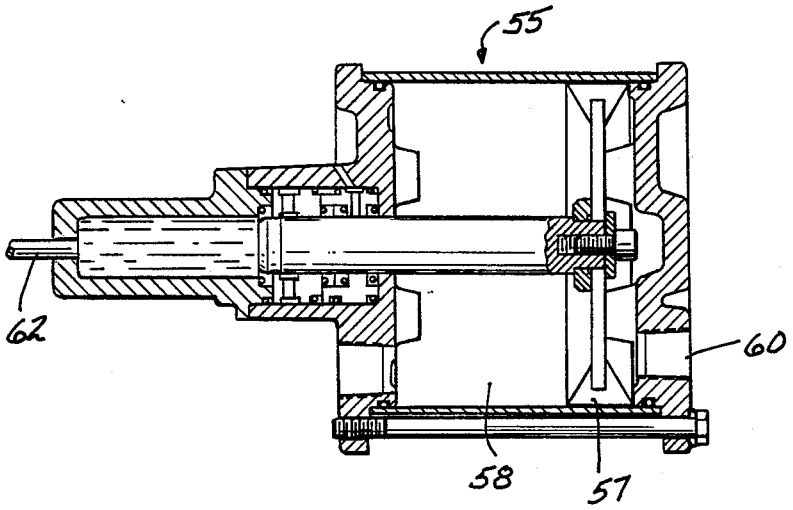
FIG. 5 is a sectional view of the power booster portion of the assembly of FIG. 4.

The riveting station further includes a power boost and ejector assembly 50, shown in FIG. 4, for operating the tool 10. The assembly 50 comprises a base member 52 with two safety hooks 54. The safety hooks 54 attach to a trolley not shown to enable the assembly to be moved during operation. An air regulator 56 is mounted to the base member 52. The air regulator communicates with a source of supply air not shown such as a dry plant air supply. The air regulator regulates the pressure of the air supplied to the riveter tool 10 via air line 35. Also mounted to the base member 52 is a power booster or intensifier 55. The power booster may comprise any suitable booster known in the art. Typically, the power booster 55 has a piston 57 reciprocably movable within a cylinder 58. The housing for the power booster has a port 60 through which air is introduced into the cylinder on one side of the piston. This air causes the piston 57 to advance into the cylinder forcing hydraulic fluid to the tool 10 via conduit 62. It is this hydraulic fluid which causes the piston 18 to move to its retracted position.

A four way directional control valve 40 is mounted to the base member 52. The valve 40 as previously discussed, receives pilot air when the trigger 30 on the tool 10 is depressed. The pilot air is introduced into the valve 40 via tee connection 64. One port of the tee connection is in fluid communication with the return air line 42 while a second port communicates with the valve 40 and a third port communicates with control device 44 via line 66. The valve 40 is also connected to the air supply not shown via air regulator 56 and line 68 and to the inlet of the power booster 55 via line 70.

As previously discussed, one of the disadvantages of prior art pop riveter installations is the absence of means for automatically discontinuing application of the air to the ejector device. Besides the obvious economic expense associated with the continuous operation of the tool, the continuous application of air poses a serious safety risk. In those instances where the ejector becomes disconnected from the collection canister, the continuous air could allow a broken stem to fly out and strike an operator or a bystander. The present invention successfully avoids these problems through the use of vacuum air and control device 44. In a vacuum system such as that of the present invention, the vacuum is lost if the line break, thus accidental ejection of the stem is impossible.

The control device 44 operates so as to cause a timed stem ejection from the tool 10 to a disposal container 72 on the assembly 10. After a present time such as a couple of seconds, the control device 44 automatically shuts off the vacuum. The control device provides as many inches of vacuum as needed for the size of the stem being ejected. The time which is set is the time needed to eject the mandrel 22 to the container 72. If desired, a regulater not shown may be added to the supply air for valve 74 to adjust the vacuum which is applied. Alternatively, the vacuum maybe adjusted by using different size supply lines for the 3-way valve 74.

The control device 44 preferably comprises an air logic timer such as the Aro Pneumatic Logic Control Model 59867. The control device is connected to the air supply via regulator 56 and to the pilot air from the tool 10 via line 66. The control device is also connected to a three way valve 74 for controlling the vacuum produced by the vacuum transducer 76. The control device 44 is adjustable such as by a screw 78 to send a timed amount of air to the three-way valve 74. This timed air in turn limits the air supplied to the transducer 76 via the line 80. As a result, the vacuum air for ejecting the rivet is supplied to the bore 26 via line 79 only for as long as the time setting on the control device 44.

The riveting tool 10 of the present invention is further characterized by the presence of special means for preventing inadvertent popping of the rivet and for promoting self-cleaning of the tool. This special means comprises a fitting 81 mounted to the tool 10 by a connector 82 such as a pipe nipple. The fitting 81 has a central bore 84 for communicating with the bore 26 in the tool. The end of the bore 84 opposed to the tool 10 communicates with vacuum air line 79 in communication with the vacuum transducer 76. The fitting further has a conduit 86 at an approximately 45° angle with respect to the bore 84. The conduit 86 is provided with a fitting 88 enabling it to be connected to a source of exhaust air from the control valve 40 via line 90. The provision of conduit 86 enables air to be blown through the bore 26 and out the front nose piece. Alternatively small holes not shown could be provided for the air to leave the tool.

The ability to blow air through the bore 26 provides several benefits. By initiating a flow of air through the bore a split second before the head retracts to pop the rivet, one can prevent the rivet being popped at the wrong time. This is a significant safety feature in that if rivets are popped at the wrong time, they can travel long distances, up to 30 feet, and possibly strike and injure someone. The flow of air initiated via fitting 81 pushes a rivet forward so that it cannot be popped if it is in an improper position i.e. not in its intended hole. By providing a second burst of air after the rivet is popped, any small metal particles either from the coating on the rivet or from breaking the stem are gently blown out the front of the tool so that they do not stay inside the tool, collecting in the collet and the jaw. This self-cleaning feature should greatly improve the length of time the tool 10 can be used without needing service. The flow of air inside the bore 26 of course ceases when the vacuum air for ejecting the broken mandrel comes on.

The riveting station shown in FIGS. 1–5 operates in the following manner. A rivet 24 to be installed is loaded into the front of tool 10. To install the rivet 24, the trigger 30 is depressed. This causes valve stem 32 to unseat ball valve 34. Supply air from the assembly 50 flows via line 35 and chamber 36 to return line 42. The return air flows through line 42 to the T-connection 64 where it is divided into two pilot air flows. The first pilot air flow is used to operate the control valve 40 while the second pilot air flow is used to operate the air logic control device 44.

The pilot air flowing into the control valve 40 causes air to flow into port 60 of the power booster 55. The air pushes piston 57 which causes hydraulic fluid to flow to the tool 10 via conduit 62. The hydraulic fluid pushes against the piston 18 and moves the piston between its initial position and its retracted position.

As the four-way valve 40 shifts, a measured amount of exhaust air passes to the bore 26 via line 90 and conduit 86 in fitting 81. The air passes through the bore 26 and out the front nose piece. If the rivet 24 is not in position to be popped, the exhaust air pushes the rivet forward so that it can not be popped. If the rivet 24 is in the correct position, the jaws 14 grasp the mandrel 22 when the piston 18 reaches its retracted air and the rivet is popped. When the mandrel is popped, exhaust air is still blow through the tool and out the front of the nose. This causes any small metal particles either from the rivet coating or from the stem breaking to be blown out the front of the tool. As the piston 18 moves back to its initial position due to the introduction of air in the back of the piston, the jaws 14 open up and release the broken mandrel 22. As it moves forward, the piston forces the hydraulic oil back into the reservoir 65 shown between control 44 and 3-way valve 74. A split second before the jaws open, the exhaust air stops and the vacuum air comes on, substantially simultaneously.

The vacuum air sequence, as previously stated, is initiated by the flow of pilot air to logic 44. The air logic in response to the pilot air provides a timed flow of air to three-way valve 74 which in turn provides a timed flow of air to vacuum transducer 76. This causes a timed application of vacuum air to bore 26. The vacuum air sucks the mandrel 22 through the bore 26 to the container 72 via passageway 84 in fitting 81 and vacuum air line 79. After the preset time, the vacuum shuts off automatically.

Figure 6:
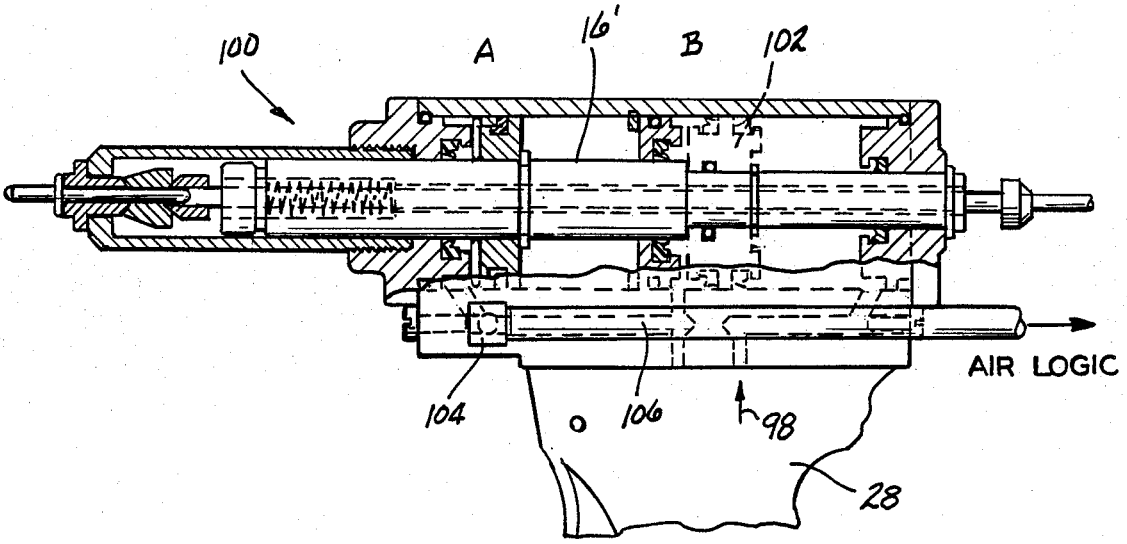
FIG. 6 is a schematic representation of a plastic rivet gun model.
Figure 8:
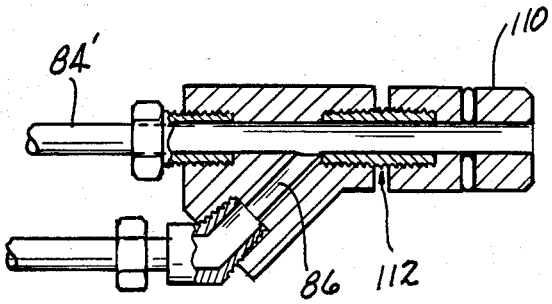
FIG. 8 is a sectional view of a fitting to be used with a riveter such as the Cherry G743 model.
Figure 7:
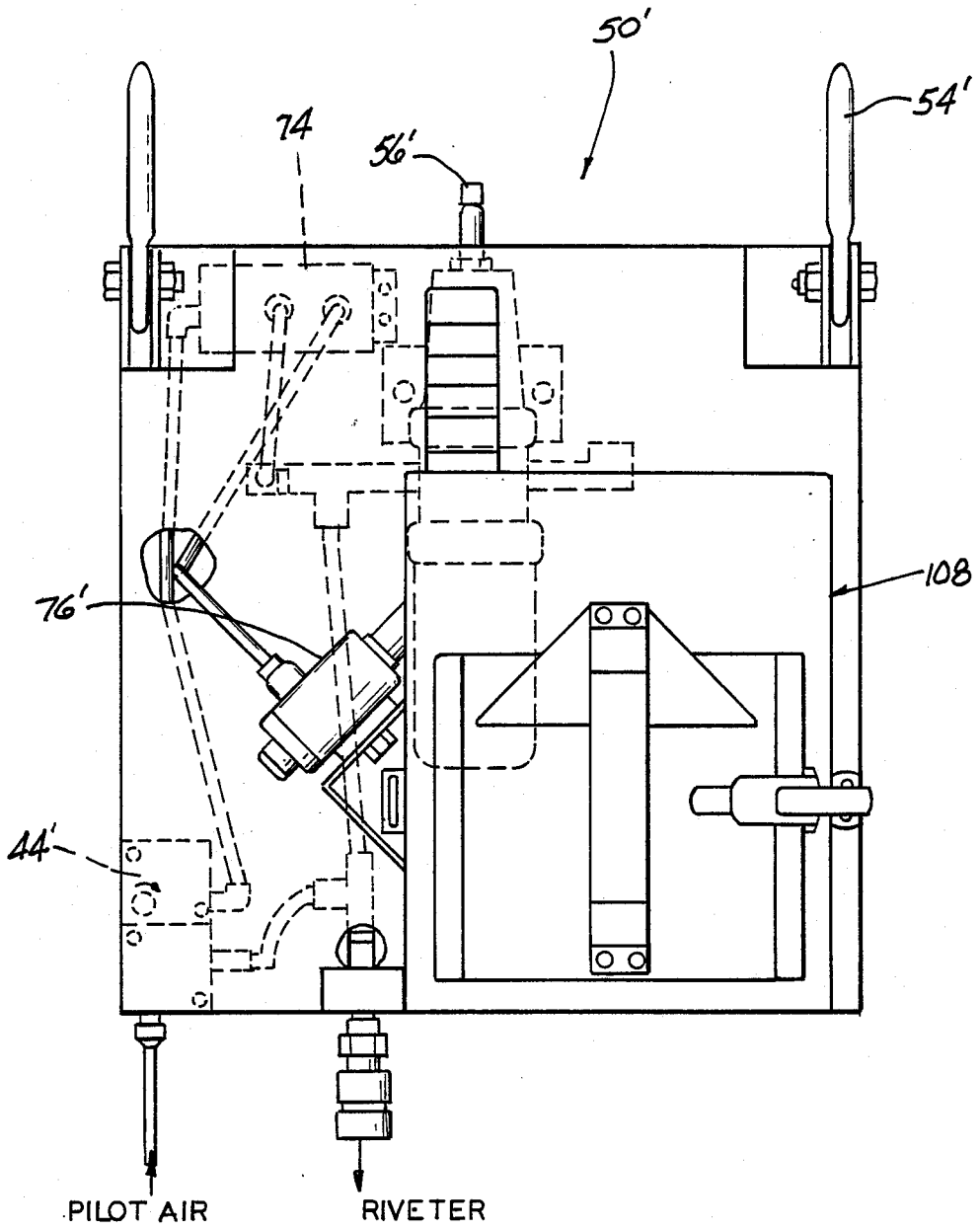
FIG. 7 is a schematic representation of a power booster and ejection assembly to be used with the tool of FIG. 6.

Referring now to FIGS. 6–8, the features of the present invention can be used in conjunction with other riveters such as the Ebbert Plastic Rivet Gun Model 28895-100 and the Cherry G743 Model. When used in conjunction with these models, the invention is modified to use exhaust air and/or pilot air from the tool itself to operate the air logic and/or provide the aforementioned safety and self-cleaning features.

FIG. 6 illustrates a plastic rivet gun 100 and FIG. 7 illustrates the power boost and ejector assembly 50' used in conjunction with the gun 100. Gun 100 has a piston 102 for operating a set of jaws 114 attached to the draw rod 16'. A constant air supply 98 is provided to the rear of piston 102 to hold the piston in an initial forward position A. When the trigger not shown is depressed a valve plate not shown in the tool is moved to let the constant air supply go to the front of the piston 102. This causes the piston to retract to position B and break the rivet stem.

As the trigger is depressed, a portion of the air going to the front of the piston 102 passes through a hole 104 tapped in the gun body. This air is passed via a conduit 106 to the air logic 44' and serves as the pilot air for operating the timed vacuum output. As before, the air logic 44' passes a timed flow of air to three way valve 74' which in turn passes a timed flow of air to transducer 76'. The timed vacuum air is applied to a bore in gun 100 for withdrawing the broken mandrel and depositing it in receptacle 108.

While the safety features of the present invention could be incorporated into the gun 100, there is no real need for them. There are no sharp edges on the plastic rivets. There also is not as much force since the tool is all air with no hydraulics.

FIG. 8 illustrates a special fitting which can be adapted to all types of riveting tools. For example, the fitting may enable use of exhaust air from certain tools such as the Cherry G 743 Model to obtain the aforementioned safety and self-cleaning features. The special fitting comprises a fitting 81' having a vacuum passageway 84' and an exhaust air passageway 86' and an adaptor 110. The adaptor 110 preferably has a snap ring which fits into the end cap of the tool not shown. The adaptor is coupled to the fitting 81' by a connector such as nipple connector 112. In addition to providing the desired safety and self-cleaning features, the exhaust air may be used to operate an air logic control device not shown for providing a timed output of vacuum air.

If it is desirable when using the station of FIGS. 1–5 to have the vacuum air on for a one-handed operation where the rivets are being installed in a downward manner and the vacuum is to hold the rivet in the tool, the trigger 30 of tool 10 may be depressed to start the vacuum before inserting the rivet into the tool. When doing this, the vacuum can be set for a time to cover the popping of many rivets before it shut off. Alternatively, the vacuum can be set to shut off almost immediately after a rivet is popped.

While the control device 44 has been described as being an Aro Logic Control device, it should be recognized that there are other air logic control devices commercially available which can be used in lieu of the Aro device.

It is apparent that there has been provided in accordance with this invention an improved pop riveter tool which fully satisfies the objects, means, and advantages set forth hereinbefore. While the invention has been described in combination with specific embodiment thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A riveting station which comprises:

a hand-held tool for installing break stem fasteners;

said tool having a housing and means for grasping the stem of the fastener;

means for ejecting said stem after said fastener has been installed;

said ejecting means including a bore in said housing and a source of vacuum air communicating with said bore to suck said stem out of said bore; and means for applying said vacuum air to said bore for a timed period comprising a vacuum transducer, valve means for providing air to said transducer for said timed period, and a timing device for supplying a timed flow of pilot air to said valve means.

2. A riveting station according to claim 1 wherein said ejecting means further includes a container for collecting each broken stem.

3. A riveting station according to claim 1 wherein said timing device has means for adjusting the period of time said pilot air is supplied to said valve means.

4. A riveting station which comprises:

a hand-held tool for installing break stem fasteners;

said tool having a housing and means for grasping the stem of the fastener;

means for ejecting said stem after said fastener has been installed;

said ejecting means including a bore in said housing and a source of vacuum air communicating with said bore to suck said stem out of said bore;

means for applying said vacuum air to said bore for a timed period; and means for delivering a flow of air to said bore prior to application of said vacuum air to substantially prevent a fastener from being popped when it is in an improper position and for promoting self-cleaning of said tool.

5. A riveting station according to claim 4 wherein said vacuum air applying means comprises a vacuum transducer and valve means for providing air to said transducer for said timed period.

6. A riveting station according to claim 5 further comprising:

a source of air;

trigger means on said tool for initiating a flow of air from said source and for providing a return air flow;

a directional control valve for operating a power booster for providing hydraulic fluid to said tool; and said control valve communicating with said return air flow.

7. A riveting station according to claim 6 further comprising:

means for providing a first portion of said return air flow to a timing device; and means for providing a second portion of said return air flow to said directional control valve to initiate operation of said power booster.

8. A riveting station according to claim 4 further comprising:

a fitting connected to said tool;

said fitting having a first passageway communicating with said bore and said vacuum air source for delivering said vacuum air to said bore; and said air delivery means comprises a second passageway in said fitting communicating with said first fitting passageway.

9. A riveting station according to claim 8 further comprising:

a control valve; and said second passageway communicating with exhaust air from said control valve.

10. A riveting station according to claim 4 wherein said delivering means comprises means for delivering exhaust air from said tool to said bore.

* * * * *